US007131497B2

(12) United States Patent
Helms et al.

(10) Patent No.: US 7,131,497 B2
(45) Date of Patent: Nov. 7, 2006

(54) ARTICULATED DRILLSTRING ENTRY APPARATUS AND METHOD

(75) Inventors: Charles M. Helms, Danbury, TX (US); Vernon E. Kauffman, Friendswood, TX (US); Douglas B. Leeth, Lake Charles, LA (US); John A. Lemke, Welsh, LA (US); Max H. Smith, Lake Charles, LA (US)

(73) Assignee: Specialty Rental Tools & Supply, LP, Alvin, TX (US)

( * ) Notice: Subject to any disclaimer, the term of this patent is extended or adjusted under 35 U.S.C. 154(b) by 78 days.

(21) Appl. No.: 10/708,750

(22) Filed: Mar. 23, 2004

(65) Prior Publication Data

US 2005/0211443 A1 Sep. 29, 2005

(51) Int. Cl.
*E21B 17/05* (2006.01)

(52) U.S. Cl. ..... 166/381; 166/77.1; 166/242.5; 166/75.11

(58) Field of Classification Search ..... 166/381, 166/339, 341, 117.5, 75.11, 77.2, 242.5, 379, 166/384, 385, 77.1
See application file for complete search history.

(56) References Cited

U.S. PATENT DOCUMENTS

| | | | | |
|---|---|---|---|---|
| 3,717,113 | A * | 2/1973 | Wilde | 114/264 |
| 4,681,162 | A | 7/1987 | Boyd | 166/242.5 |
| 4,753,291 | A | 6/1988 | Smith et al. | 166/65.1 |
| 4,842,059 | A | 6/1989 | Tomek | 166/65.1 |
| RE33,150 | E | 1/1990 | Boyd | 166/242.5 |
| 5,215,338 | A * | 6/1993 | Kimura et al. | 285/154.2 |
| 5,284,210 | A | 2/1994 | Helms et al. | 166/385 |
| 5,795,169 | A * | 8/1998 | Reed | 439/191 |
| 5,996,712 | A * | 12/1999 | Boyd | 175/321 |
| 6,269,879 | B1 * | 8/2001 | Boyd | 166/242.5 |
| RE37,867 | E * | 10/2002 | Gondouin | 166/380 |
| 6,520,262 | B1 | 2/2003 | Barnett et al. | 166/367 |
| 6,907,934 | B1 * | 6/2005 | Kauffman et al. | 166/379 |
| 2001/0027879 | A1 * | 10/2001 | Runia | 175/50 |
| 2005/0000684 | A1 * | 1/2005 | Slack et al. | 166/77.1 |

* cited by examiner

*Primary Examiner*—David Bagnell
*Assistant Examiner*—Shane Bomar
(74) *Attorney, Agent, or Firm*—David B. Dickinson; Lundeen & Dickinson, LLP

(57) ABSTRACT

Apparatuses and methods to allow tools disposed upon a conduit to enter the bore of a drillstring is presented. The apparatuses and methods include the use of one or more articulated knuckle joints at ends of an entry sub. The articulated knuckle joints are capable of articulating the entry sub among various conduit entry and load carrying positions.

56 Claims, 4 Drawing Sheets

ARTICULATED DRILLSTRING ENTRY APPARATUS AND METHOD

BACKGROUND OF THE INVENTION

Well drilling operations are typically performed using a long assembly of threadably connected pipe sections called a drillstring. Often, the drillstring is rotated at the surface by equipment on the rig thereby rotating a drill bit attached to a distal end of the drillstring downhole. Weight, usually by adding heavy collars behind the drill bit, is added to urge the drill bit deeper as the drillstring and bit are rotated. Because subterranean drilling generates a lot of heat and cuttings as the formation below is pulverized, drilling fluid, or mud, is pumped down to the bit from the surface.

Typically, drill pipe sections are hollow and threadably engage each other so that the bores of adjacent pipe sections are hydraulically isolated from the "annulus" formed between the outer diameter of the drillstring and the inner diameter of the wellbore (either cased or as-drilled). Drilling mud is then typically delivered to the drill bit through the bore of the drillstring where it is allowed to lubricate the drill bit through ports and return with any drilling cuttings through the annulus. Because the drillstring and wellbore are often several thousand feet in depth, a tremendous amount of pressure is required to pump the drilling mud down to the bit and back up to the surface in a complete cycle. It is not unheard of for drilling mud pressures to exceed 20,000 pounds per square inch at these depths.

Alternatively, well drilling can be accomplished through the use of a "mud motor," a device where the drilling mud flow and pressure through the drillstring is used to generate mechanical energy (through a rotor or turbine downhole) and rotate the drill bit. Mud motor systems are frequently employed where directional and/or horizontal drilling is required, for example, in deep sea operations. In mud motor arrangements, the drill string is not rotated, but is instead "slid" into the wellbore as the bit drills deeper. In order for mud motor systems to continue to operate, a differential between bore and annulus mud pressure must be maintained else the rotor or turbine assembly will not be capable of rotating the bit.

Regardless of the drilling method employed, operations of various types are performed throughout the drilling process. For instance, drill pipe sections often become stuck downhole and need to be freed. For example, directional drilling operations, wherein the drillstring is not rotated, have a higher occurrence of stuck drill pipe than traditional rotated drillstring operations. The release of stuck drill pipe is typically performed by sending a string of tools including a free-point indicator down the bore of the drillstring to determine where the pipe is stuck. Once the location is determined, reverse torque is applied to the drillstring and a charge is detonated to break the threaded joints of drill pipe free at the stuck location. With the free pipe disconnected the remainder of the drillstring can be "fished" out of the wellbore. The ability to maintain the bore and annulus of the drillstring under pressure while the recovery equipment run downhole is highly desirable.

Frequently, measurements of formation density, porosity, and permeability are made before a well is drilled deeper or before a change in drilling direction is made. Often, measurements relating to directional surveying are needed to ensure the wellbore is being drilled according to plan. Usually, these measurements and operations can be performed with a measurement while drilling assembly (MWD), whereby the measurements are made in real-time at or proximate to the drill bit and subsequently transmitted to operators at the surface through mud-pulse or electromagnetic-wave telemetry. While MWD operations are possible most of the time, manual measurements are often desired either for verification purposes or the measurements desired are not within the capabilities of the MWD system currently in the wellbore. Whatever the reason, it is desirable to maintain the differential in bore and annulus pressure downhole so that mud motors or other downhole equipment may continue to function while the operation is performed. Typically, the measurements are made by engaging a "tool" connected to a communications "conduit" within the bore of the drillstring and deploying the tool to the desired depth.

For the purposes of this disclosure, the term "tool" is very generic and may be applied to any device sent downhole to perform any operation. Particularly, a downhole tool can be used to describe a variety of devices and implements to perform a measurement, service, or task, including, but not limited to, pipe recovery, formation evaluation, directional measurement, and workover. Furthermore, the term "conduit," while frequently thought of as a tubular member for housing electrical wires, in oilfield parlance is used to describe anything capable of transmitting hydraulic, electrical, mechanical, or light communications from one location (surface) to another (downhole). For this reason, the term conduit as applied with respect to the present disclosure is to include electrical or mechanical wireline, slick line, coiled tubing, fiber optic cable, and any present or future equivalents thereof.

Historically, the deployment of tools on a communications conduit to the bore of a drillstring has been accomplished through the use of entry subs. Entry subs, in their simplest form, include two inlets and a single outlet. Fluid (drilling mud) enters through one inlet under pressure, a communications conduit is manipulated through the second inlet, or entry port, and both the conduit and the pressurized fluid exit through the single outlet. The development of entry subs over the years has yielded various improvements to oilfield technology, but has identified numerous needs as well.

Drillstring pipe sections are preferably mounted below the entry sub at the outlet and above the sub at the fluid inlet. Frequently, entry subs are used in combination with top-drive assemblies to enable tools and the conduit attached thereto to be engaged within the bore of the drillstring while the drillstring is being rotated. With a rotational swivel located between the entry sub and the rotary table of the rig floor, the top-drive assembly is used to raise, lower, and hold the entry sub rotationally still from above while the rotary table rotates the drillstring below. This combination allows the drillstring to be rotated (and prevented from becoming stuck) while the tool disposed on the communications conduit is deployed into the bore of the drillstring. Because the entry sub provides a sealing engagement with respect to the conduit entering therethrough, drilling mud can be continued to be kept at pressure while the conduit is deployed.

Formerly, entry subs were constructed as "side entry" subs, whereby the drillstring inlet and outlet were substantially coaxial and the conduit entry port was skewed at an angle to the axis of the drillstring. Examples of a side entry sub of this type can be viewed in U.S. Reissue Pat. No. RE 33,150 issued to Harper Boyd on Jan. 23, 1990 (as a reissue of U.S. Pat. No. 4,681,162 issued on Feb. 19, 1986) both hereby incorporated by reference herein.

This arrangement required the conduit and any tool attached thereto to overcome an angle of inclination in order to pass through the tool body en route to the lower pipe section. For this reason, only the smallest and most flexible of tools (and conduits) were capable of being used with the side entry sub, severely limiting the benefits of using the device. Larger, more rigid, tools required the bottom drillstring connection to be separated (preventing the maintenance of drilling fluid bore pressure) while the tools were "made up" and inserted into the bore of the drillstring. These tools would be connected to the conduit (previously stripped through the side entry port) and run partially into the drillstring before the connection between the side entry sub and the drillstring (as well as the drilling fluid pressure) could be restored. These operations required a lengthy break in mud flow operations that could be costly in terms of rig time.

Over time, entry subs were improved and were developed as top entry subs, whereby inlet and outlet drillstring pipe sections are no longer co-axial. Preferably, the conduit entry port (top entry port) was located substantially coaxial with the lower drillstring outlet so that the inlet drillstring connection was skewed at an angle to the axis formed by the top entry port and the lower drillstring. Examples of a top entry sub of this type can be viewed in U.S. Pat. No. 5,284,210 issued on Feb. 8, 1994 to Charles M. Helms and Charles W. Bleifeld hereby incorporated herein by reference. This "bend the fluid instead of bend the tools" approach was a success and resulted in adoption throughout the industry.

However, another primary function of the top entry sub (as a member of the drillstring) is to support the total weight of the complete length of the drillstring. To manipulate the drillstring up and down into the well, the top-drive assembly (or derrick crane lifting block) must be capable of lifting several thousand feet of steel drill pipe at one time. While the drilling fluid serves to buoy some of this total weight, lengthy drillstrings frequently weigh hundreds of thousands of pounds, depending on their length, diameter, and sidewall thickness. As an integral component of the drillstring when installed, the top entry sub must also be capable of supporting loads of this type. However, much concern arose with the loading capabilities of the top entry sub because of the axial offset between the bottom drillstring connection and the top drillstring connection. This offset, while allowing a conduit and tools attached thereto to be engaged straight into the drillstring without overcoming a bend angle, could potentially induce bending moments and loads in the body of the top entry sub if high tensile loads were applied across drillstring inlet and drillstring outlet ports.

As a result of these concerns, investigations were performed to determine the bending moments experienced across the top entry sub and within the rotary threaded connections for the drillstring components attached thereto. While the results indicate that the bending loads and moments are not a significant factor, there is still the perception by some in the industry that the loads remain a factor. Additionally, as drilling technology progresses, deeper and smaller diameter wells are being drilled everyday, particularly offshore in deep water situations. Therefore, the offset nature of the top entry sub may again become an issue in that deeper wells require longer lengths of pipe, resulting in even higher tensile loads. Furthermore, the smaller "gauge" drillstring that may be employed would require a similarly gauged top entry sub, one that may not, if produced, be capable of carrying the higher tensile loads without incurring the problems associated with bending moments. An entry sub arrangement capable of both allowing tools disposed upon a communications conduit to be engaged into the bore of a drillstring and handling extreme tensile drillstring loads would be highly desirable.

BRIEF SUMMARY OF THE INVENTION

The deficiencies of the prior art are addressed by an apparatus located above a wellhead to allow a communications conduit to enter the drillstring. The apparatus preferably includes a main body with an upper and a lower end, wherein the lower end includes a lower connection to the drillstring and the upper end includes an entry port and an upper connection to the drillstring. The apparatus also preferably includes at least one articulated knuckle joint to allow deflection of the main body with respect to the lower connection to the drillstring. The apparatus is preferably configured to provide fluid communication from the upper connection to the drillstring and the lower connection of the drillstring. The apparatus also preferably includes a communications pathway extending through the sub body from the entry port to the lower connection to the drillstring. The communications pathway is preferably configured to receive the communications conduit therethrough.

Alternatively, the articulating knuckle joint can be configured to allow deflection of the main body with respect to the upper connection of the drillstring. Alternatively still, the apparatus can include a second articulating joint, such that one is configured to allow deflection of the main body with respect to the lower connection of the drillstring and the other is configured to allow deflection of the main body with respect to the upper connection to the drillstring. The articulating knuckle joint(s) can be configured to allow or restrict rotation of the drillstring relative to the main body. The articulating knuckle joints can be configured to prevent bending moment loads from acting across the main body. Alternatively, the communications profile can include a receiving profile, one that may include a hardened wear-resistant material or a replaceable wear sleeve. Alternatively still, the articulated knuckle joint(s) may include a replaceable wear sleeve.

In another embodiment, an entry sub includes a tubular member with opposed articulating joints at respective first and second ends thereof, a first longitudinal passage in the tubular member opening at the joint at the first end, a second longitudinal passage in the tubular member diverging from the first longitudinal passage and in communication between the first longitudinal passage and the joint at the second end, and a third longitudinal passage in the tubular member in communication between the first longitudinal passage and a port in the second end of the tubular member. In yet another embodiment, an articulated top entry sub includes a tubular member, a first longitudinal bore into the member from a lower drillstring port at a lower end, a second longitudinal bore into the member from a wireline entry port at an upper end to communicate with the first longitudinal bore, a third longitudinal bore from an upper drillstring port at the upper end to communicate with the first longitudinal bore at a divergent angle, an upper drillstring connection sub having a lower end terminating at an upper deflection joint in the upper drillstring port having a maximum deflection angle at least as great as the divergent angle, and a lower drillstring connection sub having an upper end terminating at a lower deflection joint in the lower drillstring port having a maximum deflection angle at least as great as the divergent angle. In another embodiment, the joints can include a sleeve formed in each respective drillstring port having an annular posterior shoulder with an outside diameter greater than the respective bore, a convex rotational surface at an enlarged terminus of the drillstring connection having a diameter less than the sleeve and greater than the bore, a posterior annular seat between the terminus and the shoulder comprising a matching concave rotational surface, an anterior annular seat having an outside diameter to be received in the sleeve, a matching inside concave rotational surface, and an inside diameter greater than an outside diameter of a longitudinal section of the respective drillstring connection sub, and a retention nut threadably received in the sleeve to secure the annular seats and having an inside diameter larger than the outside diameter of the longitudinal section.

The deficiencies of the prior art can also be addressed by a method to deploy tools connected to a distal end of a communications conduit into a drillstring by connecting an articulatable entry sub to the drillstring, wherein the entry sub provides an entry port, upper and lower connections to the drillstring, and an articulated knuckle joint. Preferably, the entry port is connected to the lower connection of the drillstring by a communications pathway. The method preferably includes articulating the entry sub so the communications pathway and the lower connection to the drillstring are substantially coaxial. The method preferably includes engaging tools through the entry port, the communications pathway, the lower connection to the drillstring, and into a portion of the drillstring located below the entry sub. The method preferably includes articulating the entry sub so the communications pathway is axially skewed from the lower connection to the drillstring. In another embodiment, a wireline service method for a drill string including a top drive and a rotary table includes installing a top entry sub with opposing deflection knuckles into the drill string above the rotary table and below the top drive, positioning the deflection knuckles to align an entry port of the top entry sub with the drill string below the top entry sub and offset the drill string above the top entry sub, inserting a wireline tool suspended from a wireline through the aligned entry port into the drill string below the entry sub, positioning the deflection knuckles to align the drill string above and below the entry sub and offset the entry port, and operating the tool in the drill string below the entry sub with the wireline through the entry port.

Alternatively, the method can include axially loading the drillstring across the articulatable entry sub when the communications pathway is axially skewed from the lower connection to the drillstring. The method can also alternatively include an articulatable entry sub having a second articulated knuckle joint, wherein one joint is located at the upper connection to the drillstring and the second joint is located at the lower connection to the drillstring. Alternatively still, the method can also include shifting the communications pathway from a coaxial to a skewed alignment with the lower connection to the drillstring by applying a tensile load to the drillstring across the articulatable entry sub.

BRIEF DESCRIPTION OF THE DRAWINGS

For a more detailed description of the preferred embodiments of the present invention, reference will be made to the accompanying drawings, wherein.

DETAILED DESCRIPTION OF THE PREFERRED EMBODIMENTS

Figure 1:
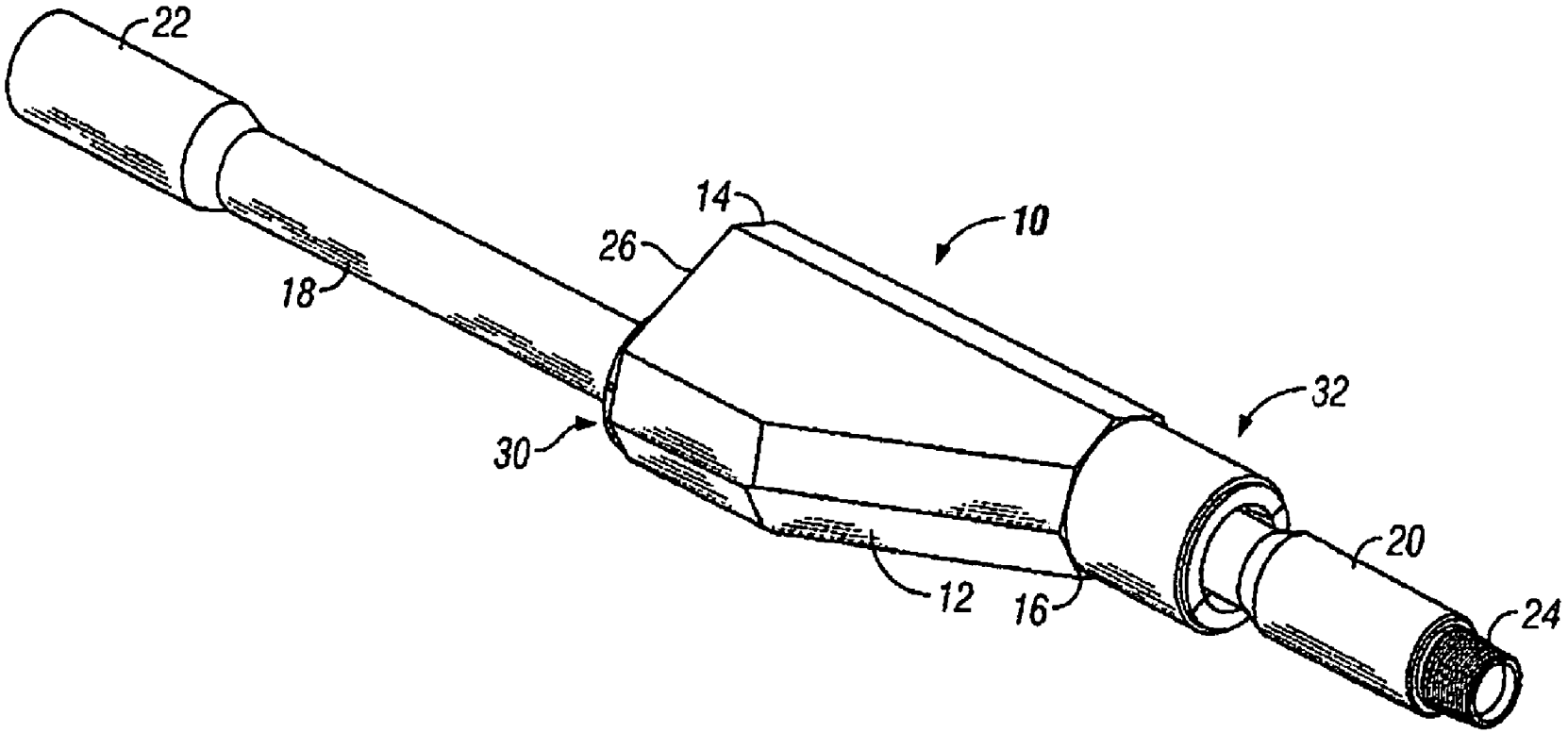
FIG. 1 is a profile view drawing of an entry sub constructed in accordance with a preferred embodiment of the present invention in a straight position.

Referring initially to FIG. 1, a profile-view drawing of an entry sub system 10 having two articulated knuckle joints 30, 32 is shown. Entry sub system 10 includes an entry sub body 12 having an upper end 14 and a lower end 16. Sub body 12 may be constructed as a tubular body or any other structurally sound configuration. An upper section of pipe 18 extends up from upper knuckle joint 30 at upper end 14 and a lower section of pipe 20 extends from lower knuckle joint 32 at lower end 16. Pipe sections 18 and 20 each include rotary threaded drillstring connections 22, and 24 respectively. Threaded drillstring connections 22 and 24 are commonly referred to in the art as "tool joints," in that they allow for the connection of additional oilfield tools or drillstring components thereto. Threaded drillstring connections 22, 24 can be of any rotary threaded tool joint connections as one skilled in the oilfield arts would have available, but are preferably standard American Petroleum Institute (API) designs. Preferably, threaded drillstring connections 22, 24 are sized and specified so as to match corresponding tool joints of adjacent drillstring components (not shown).

Entry sub system 10 is preferably installed above a wellhead with the remainder of the drillstring (not shown) mounted below at connection 24 and above at connection 22. While installed in a drillstring, entry sub system 10 allows for the transfer of drillstring fluids and loads therethrough, all the while providing for the entry of tools into the drillstring through an entry port 26 (more easily viewed in sectioned FIG. 2). Using entry sub system 10, a drilling operator is able to maintain drilling fluids in the bore of the drillstring at pressure while allowing tools inserted into the pressurized bore through entry port 26 to perform oilfield operations below. Tools inserted through entry port 26 can be of numerous functions and types and will typically be deployed upon the distal end of a communications conduit. Entry port 26 of sub body 12 is preferably sized and constructed so that as many tools as possible are able to pass therethrough, into lower pipe section 20, and further downhole. Entry port 26 is preferably constructed so that lower knuckle joint 32 can be manipulated so that the center axis of lower pipe section 20 is substantially coaxial to the center axis of entry port 26, thereby allowing passage of tools and communications conduit therethrough with little or no obstruction.

Figure 2:
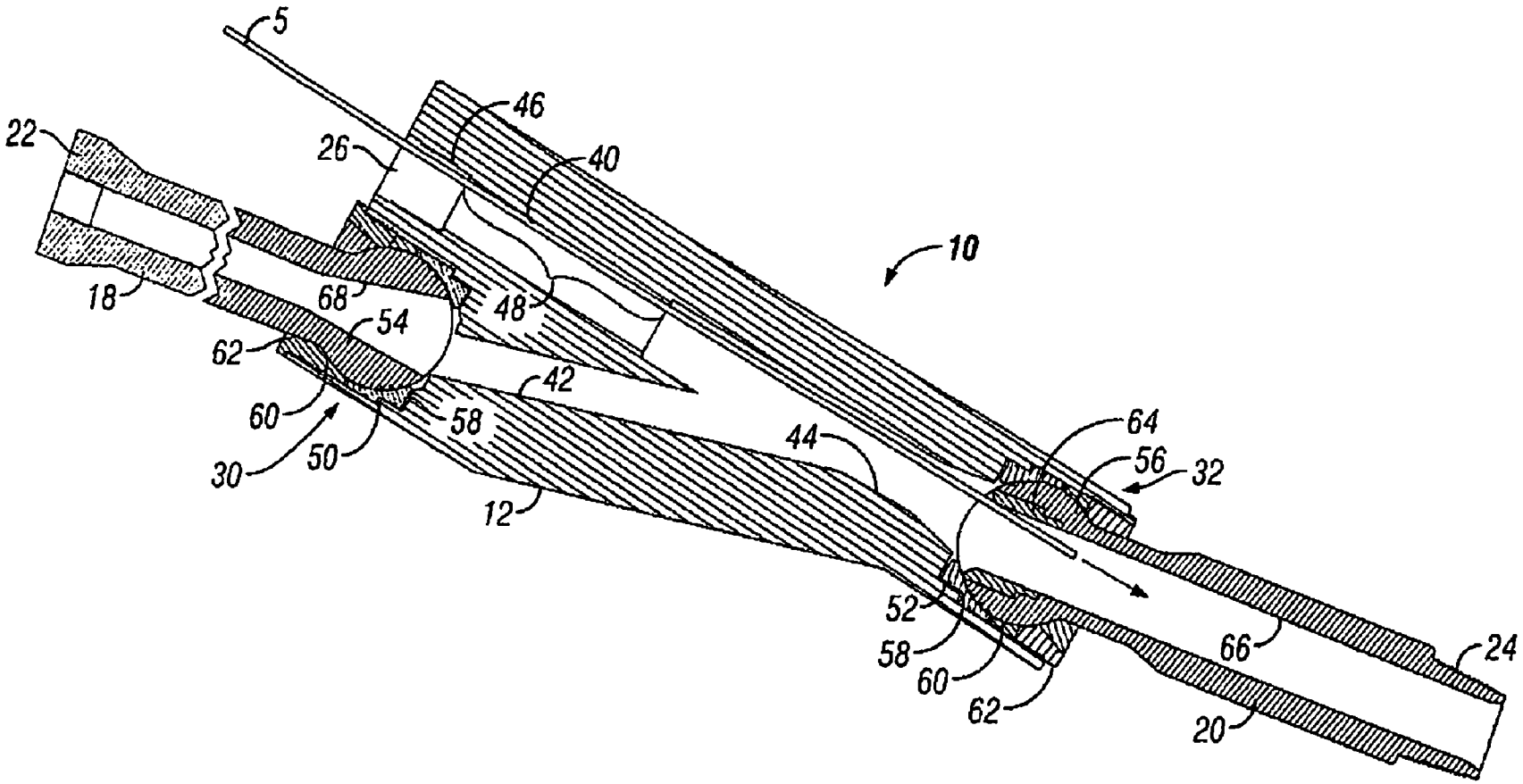
FIG. 2 is cross-sectional profile view drawing of the entry sub of FIG. 1 in an articulated position.

Referring now to FIG. 2, a cross-sectional profile view of the entry sub system 10 is shown. As can now be seen more clearly, sub body 12 includes a conduit entry passage 40, a fluid inlet passage 42, and a fluid and conduit exit passage 44. A communications conduit 5 is shown entering sub body 12 at entry port 26, extending through conduit entry passage 40 until it reaches fluid and conduit exit passage 44 where it proceeds with fluid flow from fluid inlet passage 42 through lower knuckle joint 32 into lower pipe section 20. Preferably, a hydraulic pack off device (not shown), known to one skilled in the art, is located at a receptacle 46 at the beginning of conduit entry passage 40 at entry port 26 to prevent hydraulic fluid from passages 40, 42, and 44 from escaping entry sub system 10 around communications conduit 5 or when communications conduit 5 is absent.

Optionally, a receiving profile 48 can be located within conduit entry passage 40 along the length of sub body 12 where communications conduit 5 would be expected to contact and abrade the wall of conduit entry passage 40. Receiving profile 48 may be of any type and design to prevent abrasion of passages 40 and 44 resulting from extended manipulation of communications conduit 5 therethrough. One example for receiving profile 48 would include a build-up of hardened, wear-resistant, material such that life of sub body 12 is maximized. Alternatively, receiving profile 48 can be constructed as a replaceable sleeve of hardened material that could be replaced when worn.

As communications conduit 5 passes through fluid and conduit exit passage 44, lower knuckle joint 32 is encountered. Knuckle joints 30 and 32 are preferably constructed as ball-and-socket joints but any flexible joint (including, but not limited to, a U-joint design) known to one skilled in the art may be employed. Knuckle joints are shown located within receptacles 50, 52 of sub body 12 and are designed to receive substantially spherical ends 54, 56 of pipe sections 18 and 20, respectively. Furthermore, knuckle joints 30, 32 may also be constructed to either restrict or allow relative rotational movement between sub body 12 and pipe sections 18, 20. By adding splines (or their mechanical equivalent) to substantially spherical ends 54, 56, they can be prevented from rotating with respect to their receptacles 50, 52 in sub body 12.

To receive substantially spherical ends 54, 56, spherical sockets 58 are placed within receptacles 50 and 52. Spherical sockets 58 may be constructed of any material known in the art, but are preferred to be manufactured of high-strength and wear-resistant materials to maximize their longevity. Furthermore, sealing methods known in the art may be easily employed to prevent fluid from passages 40, 42, and 44 from escaping through any interfaces between spherical sockets 58 and receptacles 50, 52 or between spherical sockets 58 and substantially spherical ends 54, 56. Metal-to-metal seals, elastomeric seals, and fiber-reinforced polymer seals can be so employed. If substantially spherical end 54, 56 to sub body rotation is desired, the seals must be capable of experiencing the rotation without a loss in performance.

Following installation of spherical socket 58 into receptacle 50, 52, substantially spherical ends 54, 56 are engaged therein, and compression rings 60 are installed. Compression rings 60 may also be of any material known in the art but are also preferred to have high compressive strength and good wear resistance. Furthermore, to ease in their installation, compression rings 60 may be segmented (for instance, in halves) so the outside diameters of pipe sections 18, 20 may be larger than the internal diameters of compression rings 60. Finally, compression nuts 62 are installed behind compression rings 60 and tightened to compress knuckle joints 30, 32 together and properly seat any seals therein.

Additionally, a replaceable abrasion sleeve 64 may be installed within substantially spherical end 56 of lower knuckle joint 32 to protect the material of lower pipe section 20 from abrasion from continued manipulation of communications conduit 5 therethrough. Abrasion sleeve 64 is preferably constructed of a hardened metal but may also be constructed as a relatively soft material with an applied hardness coating to increase wear resistance thereof. Finally, a hardened sleeve or hardened coating may optionally be applied to inner diameter 66 of lower pipe section 20 to resist any wearing experienced thereof from communications conduit 5.

Referring briefly to upper knuckle joint 30, no hardened wear sleeve is shown. Instead, substantially spherical end 54 includes a conical profile 68 that allows fluid flowing therethrough to pass more easily. Because no communications conduit 5 is expected to pass through upper knuckle joint 30, a hardened wear sleeve (similar to item 64) is not needed, but may, nonetheless, be used. Optionally, upper pipe section 18 can be constructed similarly to lower pipe section 20 below in the event that lower pipe section 20, or its components, becomes worn and no replacement is immediately available. If components of lower pipe section 20 become worn, it can be swapped with upper pipe section 18, allowing operations to continue while replacements are located.

FIG. 2 shows entry sub system 10 experiencing a tensile load condition, one where the central axis of pipe sections 18 and 20 are substantially coaxial, in contrast to FIG. 1 where entry port 26 and lower pipe section 20 are substantially coaxial. This condition occurs when large tensile loads (for example, when the drillstring is lifted or maintained in tension by the top-drive assembly or traveling block of the oil derrick) are placed across sub body 12 through pipe sections 18 and 20. Knuckle joints 30, 32 are constructed to be capable of carrying significant tensile loads without hazard. In the position shown in FIG. 2, knuckle joints 30, 32 allow sub body 12 to be cocked to the side and thereby prevent any bending moments from building up therein. As such, the tensile forces from below are carried through lower knuckle joint 32, sub body 12, and up through upper knuckle joint 30 to the traveling block and/or top-drive assembly coaxially without placing any drilling components in any bending conditions.

In the configuration shown in FIG. 2, entry port 26 permits communication of communications conduit 5 and any tools attached thereto through lower knuckle joint 32, lower pipe section 20, and into the remainder of the drillstring, but the amount of clearance is diminished by the angular displacement between entry port 26 and lower pipe section 20. This diminished amount of clearance may prevent the largest and most inflexible tools from being able to pass through lower knuckle joint 32, fluid and conduit exit passage 44, and conduit entry passage 40, but many useful tools will still be able to pass. When larger clearance from entry port 26 through to lower pipe section 20 and drillstring connected thereto is needed, the axial drillstring loading can be temporarily reduced (for example, by setting slips below), thereby allowing the conduit entry passage 40 and lower pipe section 20 to once again line up in a substantially coaxial arrangement, allowing tools and conduit to be easily engaged or removed therethrough. Once the tool or conduit is removed or inserted, the drillstring loading can be reapplied, allowing knuckle joints 30, 32 to tilt sub body 12 again. While a reduced clearance for communications conduit 5 and tools exists in the position shown in FIG. 2, there still remains enough clearance for manipulation of the conduit in and out of the wellbore.

Furthermore, while FIGS. 1 and 2 depict an entry sub system 10 having two knuckle joints, 30 and 32, it should be understood by one of ordinary skill in the art that a system might be employed that uses only one knuckle joint. The single joint system (not shown) could be manufactured at a lower cost than a two joint system, and could be capable of reducing bending loads to a tolerable amount. The single knuckle system could be constructed with the knuckle at either the upper or the lower connection to the drillstring, depending on the preference of the operator.

Figure 3:
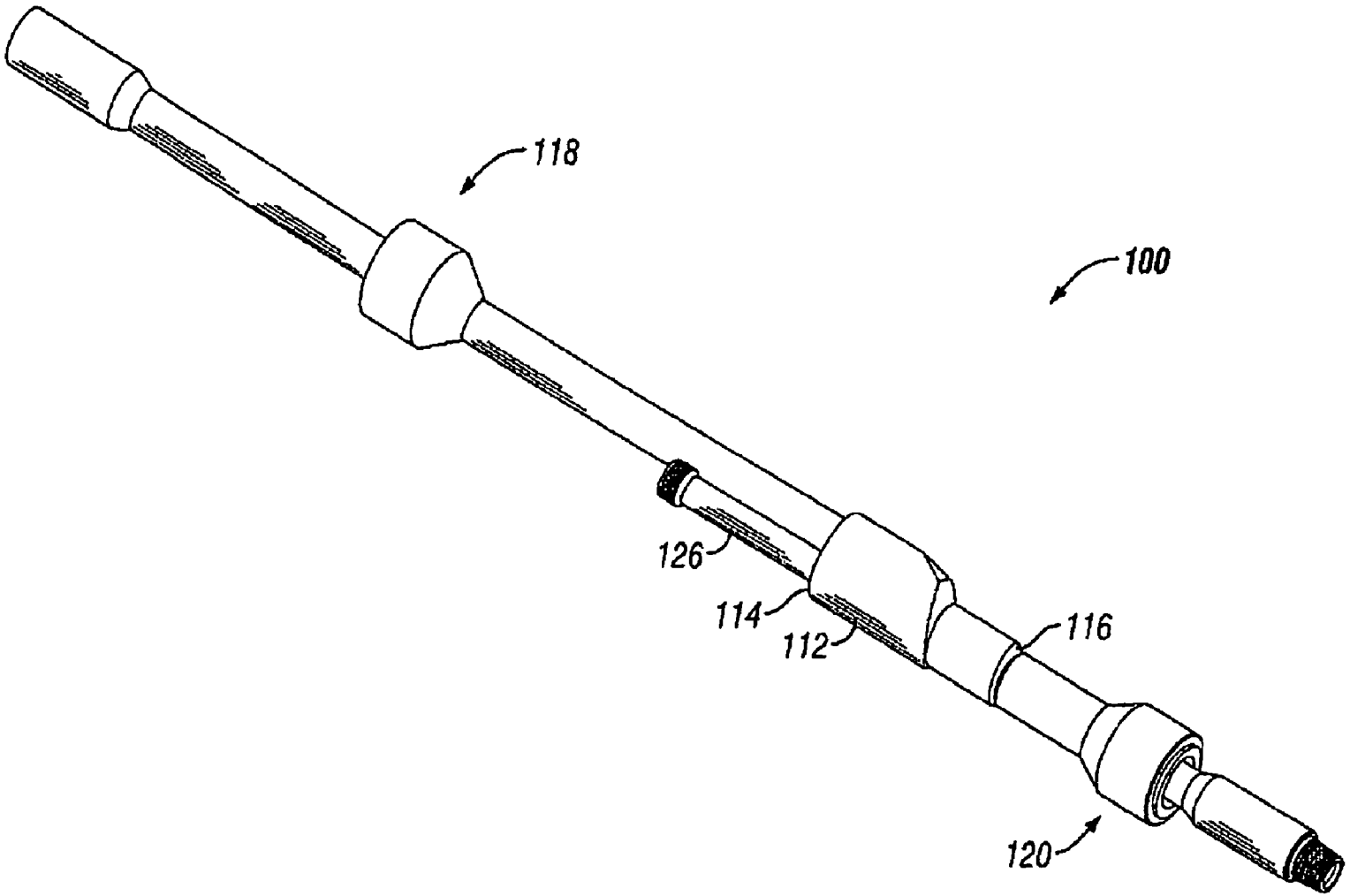
FIG. 3 is a profile view drawing of an entry sub constructed in accordance with a second preferred embodiment of the present invention.
Figure 4:
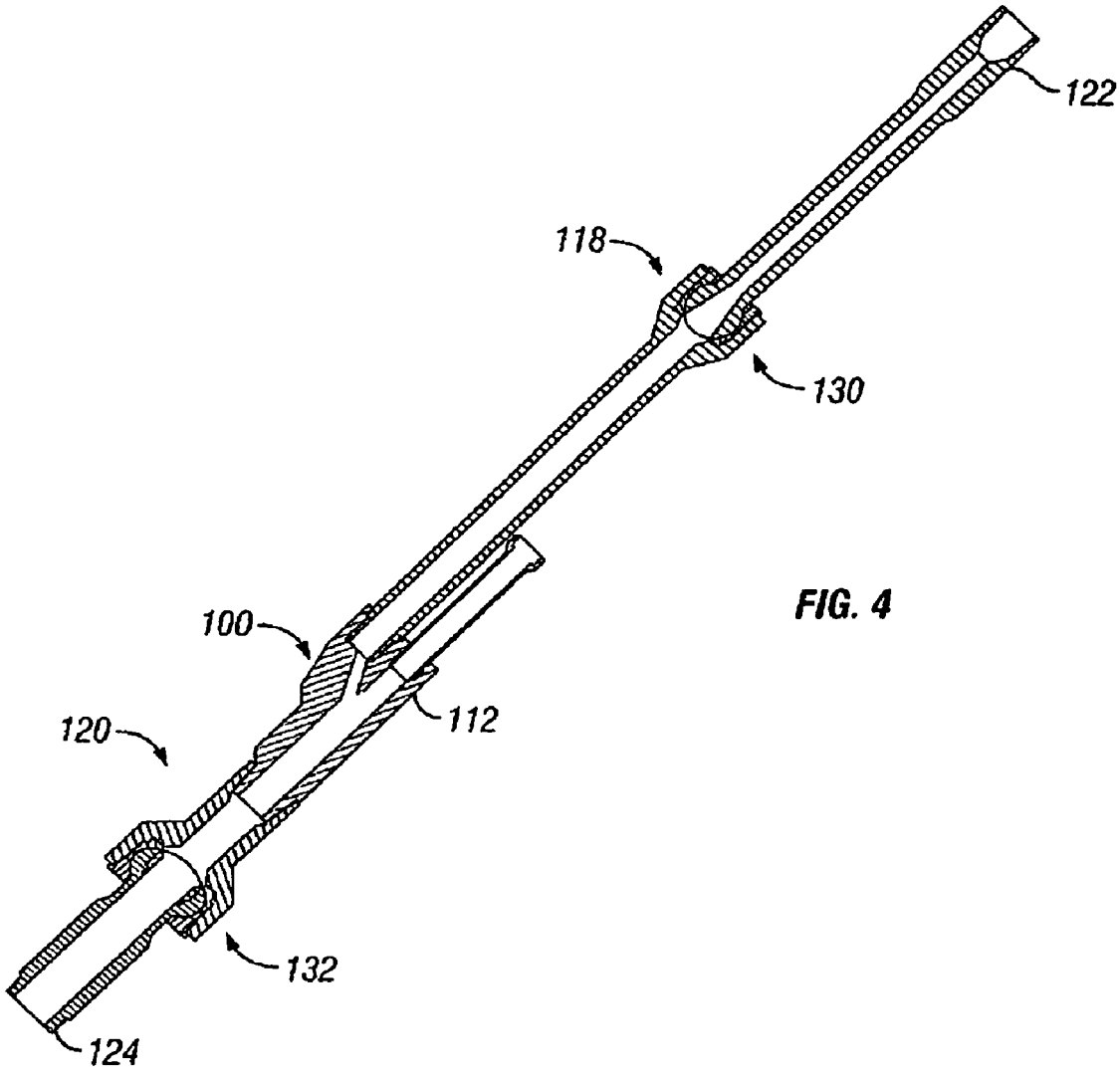
FIG. 4 is a cross-sectional profile view drawing of the entry sub of FIG. 3.

Referring briefly to FIGS. 3 and 4 together, an alternate embodiment of the entry sub system 100 is shown. Entry sub system 100 is configured to allow an existing top entry sub 112 (or in some instances, a side entry sub) without knuckle joints to be converted for knuckle joint use. Particularly, entry sub system 100 includes an upper knuckle adapter 118 and a lower knuckle adapter 120. Upper knuckle adapter 118 is attached to a drillstring inlet located at an upper end 114 of existing top entry sub 112 while lower knuckle adapter 120 is attached to a drillstring outlet located at a lower end 116 of existing top entry sub 112. Each knuckle adapter 118, 120 would likewise provide a corresponding knuckle joint 130, 132 and a subsequent connection to the drillstring 122,124. The ability to convert prior entry subs for knuckle joint use avoids scrapping potentially outdated technology (cost savings) and allows a rigsite operator to customize his or her entry sub solution according to their particular needs (customer choice).

Numerous embodiments and alternatives thereof have been disclosed. While the above disclosure includes the best mode belief in carrying out the invention as contemplated by the named inventors, not all possible alternatives have been disclosed. For that reason, the scope and limitation of the present invention is not to be restricted to the above disclosure, but is instead to be defined and constructed by the appended claims.

The invention claimed is:

1. An apparatus located above a wellhead to allow a communications conduit to enter a drillstring, the apparatus comprising:

a main body having an upper end and a lower end, said lower end including a lower connection to the drillstring and said upper end providing an upper connection to the drillstring and an entry port;

an articulated knuckle joint to allow deflection of said main body relative to said lower connection to the drillstring;

said main body configured to provide fluid communication between said upper connection and said lower connection; and a communications pathway extending through said main body from said entry port to said lower connection wherein said pathway is configured to receive the communications conduit therethrough.

2. The entry device of claim 1 further comprising a second articulated knuckle joint to allow deflection of said main body relative to said upper connection to the drillstring.

3. The apparatus of claim 1 wherein said articulated knuckle joint restricts relative rotation between said lower connection to the drillstring and said main body.

4. The apparatus of claim 1 wherein said articulated knuckle joint permits relative rotation between said lower connection to the drillstring and said main body.

5. The apparatus of claim 1 further comprising one or more downhole tools attached at a distal end of the communications conduit.

6. The apparatus of claim 1 wherein said main body and said articulated knuckle joint are configured to transmit tensile drillstring loads from between said upper connection and said lower connection of the drillstring.

7. The apparatus of claim 1 wherein said articulated knuckle joint prevents bending moment loads from acting across said main body.

8. The apparatus of claim 1 wherein said communications pathway is substantially coaxial with said lower connection to the drillstring when tools disposed upon said communications conduit are passed therethrough.

9. The apparatus of claim 1 wherein said communications pathway and said lower connection to the drillstring are axially skewed when tension loads are applied across said upper and said lower connections to the drillstring.

10. The apparatus of claim 1 wherein said communications pathway includes a receiving profile.

11. The apparatus of claim 10 wherein said receiving profile includes a hardened, wear-resistant material.

12. The apparatus of claim 10 wherein said receiving profile includes a replaceable wear sleeve.

13. The apparatus of claim 1 wherein said articulated knuckle joint includes a replaceable wear sleeve.

14. The apparatus of claim 1 wherein the communications conduit is selected from the group consisting of wireline, coiled tubing, fiber optic cable, braided wire, and slick line.

15. An apparatus located above a wellhead to allow a communications conduit to enter a drillstring, the apparatus comprising:

a main body having an upper end and a lower end, said lower end including a lower connection to the drillstring and said upper end providing an upper connection to the drillstring and an entry port;

an articulated knuckle joint to allow deflection of said main body relative to said upper connection to the drillstring;

said main body configured to provide fluid communication between said upper connection and said lower connection; and a communications pathway extending through said main body from said entry port to said lower connection wherein said pathway is configured to receive the communications conduit therethrough.

16. An improved entry sub located above a wellhead to allow the insertion and removal of tools disposed upon a distal end of a communications conduit, the improvement comprising:

an articulated knuckle joint configured to allow relative deflection between an entry sub and a drillstring, wherein said articulated knuckle joint prevents bending moment loads from acting across said entry sub and is located between the entry sub and at least one of an upper and a lower connection to the drillstring.

17. The improved entry sub of claim 16 further comprising a second articulated knuckle joint, wherein one of the articulated knuckle joints is located between the entry sub and the upper connection to the drillstring and the other articulated knuckle joint is located between the entry sub and the lower connection to the drillstring.

18. The improved entry sub of claim 16 wherein the entry sub is a top entry sub.

19. The improved entry sub of claim 16 wherein the entry sub is a side entry sub.

20. The improved entry sub of claim 16 wherein a communications pathway is substantially coaxial with the lower connection to the drillstring when the tools disposed upon the communications conduit are passed therethrough.

21. The improved entry sub of claim 16 wherein a communications pathway is axially skewed from the lower connection to the drillstring when the drillstring is in tension.

22. A method to deploy tools connected to a distal end of a communications conduit into a drillstring, the method comprising:

connecting an articulatable entry sub to the drillstring, the articulatable entry sub providing an entry port, an upper connection to the drillstring, a lower connection to the drillstring, and an articulated knuckle joint, wherein the entry port is connected to the lower connection of the drillstring by a communications pathway;

positioning the articulatable entry sub so the communications pathway and the lower connection to the drillstring are substantially coaxial;

engaging tools through the entry port of the articulatable entry sub, through the communications pathway, through the lower connection to the drillstring, and into a portion of the drillstring located below the articulatable entry sub; and positioning the articulatable entry sub so the communications pathway is axially skewed from the lower connection to the drillstring.

23. The method of claim 22 further comprising axially loading the drillstring across the articulatable entry sub when the communications pathway is axially skewed from the lower connection to the drillstring.

24. The method of claim 22 wherein the articulatable entry sub further comprises a second articulated knuckle joint, wherein the first articulated knuckle joint is located at the upper connection to the drillstring and the second articulated knuckle joint is located at the lower connection to the drillstring.

25. The method of claim 22 further comprising shifting the communications pathway from coaxial to skewed alignment with the lower connection to the drillstring by applying a tensile load to the drillstring across the articulatable entry sub.

26. An entry sub comprising:

a tubular member with opposed articulating joints at respective first and second ends thereof;

a first longitudinal passage in the tubular member opening at the joint at the first end;

a second longitudinal passage in the tubular member diverging from the first longitudinal passage and in communication between the first longitudinal passage and the joint at the second end;

and a third longitudinal passage in the tubular member in communication between the first longitudinal passage and a port in the second end of the tubular member.

27. The entry sub of claim 26 wherein the articulating joints comprise deflection knuckles.

28. The entry sub of claim 26 wherein the articulating joints comprise swivels to provide for rotation of the tubular member about a longitudinal axis with respect to the joints.

29. The entry sub of claim 26 further comprising a wear sleeve in the joint at the first end.

30. The entry sub of claim 26 wherein the joints are articulatable into axial alignment under tension.

31. The entry sub of claim 26 wherein the joints include drill pipe connections.

32. The entry sub of claim 31 wherein the port at the second end includes a wireline entry connection.

33. The entry sub of claim 26 wherein the joints are articulatable between a first position wherein the joints are in alignment with a longitudinal axis and the port at the second end is offset from the axis, and a second position wherein the joint at the first end is axially aligned with the port at the second end and the joint at the second end is offset from the axis.

34. The entry sub of claim 26 further comprising a coaxial bore defining the first and third longitudinal passages and a divergent intersecting bore defining the second longitudinal passage.

35. An articulated top entry sub, comprising:

a tubular member;

a first longitudinal bore into the member from a lower drillstring port at a lower end;

a second longitudinal bore into the member from a wireline entry port at an upper end to communicate with the first longitudinal bore;

a third longitudinal bore from an upper drillstring port at the upper end to communicate with the first longitudinal bore at a divergent angle;

an upper drillstring connection sub having a lower end terminating at an upper deflection joint in the upper drillstring port having a maximum deflection angle at least as great as the divergent angle; and a lower drillstring connection sub having an upper end terminating at a lower deflection joint in the lower drillstring port having a maximum deflection angle at least as great as the divergent angle.

36. The articulated top entry sub of claim 35 wherein the deflection joints comprise knuckle joints.

37. The articulated top entry sub of claim 35 wherein the deflection joints comprise ball joints.

38. The articulated top entry sub of claim 37 wherein the deflection joints provide for rotation of at least one of the drillstring connections with respect to the tubular member.

39. The articulated top entry sub of claim 35 wherein the first and second longitudinal bores are coaxial.

40. The articulated top entry sub of claim 39 wherein the coaxial bores have the same inside diameter to provide a continuous bore through the longitudinal member.

41. The articulated top entry sub of claim 35 wherein the first and second longitudinal bores are divergent.

42. The articulated top entry sub of claim 35 wherein the joints each comprise:

a sleeve formed in each respective drillstring port having an annular posterior shoulder with an outside diameter greater than the respective bore;

a convex rotational surface at an enlarged terminus of the drillstring connection having a diameter less than the sleeve and greater than the bore;

a posterior annular seat between the terminus and the shoulder comprising a matching concave rotational surface;

an anterior annular seat having an outside diameter to be received in the sleeve, a matching inside concave rotational surface, and an inside diameter greater than an outside diameter of a longitudinal section of the respective drillstring connection sub;

and a retention nut threadably received in the sleeve to secure the annular seats and having an inside diameter larger than the outside diameter of the longitudinal section.

43. The articulated top entry sub of claim 42 further comprising seals disposed between the convex rotational surface and the concave rotational surface of the posterior seat, and between an outside diameter of the posterior annular seat and an inside diameter of the sleeve.

44. The articulated top entry sub of claim 43 wherein the annular shoulder of the sleeve and the outside diameter of the posterior annular seat are stepped to form an annular recess receiving a wear seal.

45. The articulated top entry sub of claim 42 further comprising a wear sleeve disposed inside the lower drillstring connection sub at an upper end of the enlarged terminus.

46. A wireline service method for a drill string comprising a top drive and a rotary table, comprising:

installing a top entry sub with opposing deflection knuckles into the drill string above the rotary table and below the top drive;

positioning the deflection knuckles to align an entry port of the top entry sub with the drill string below the top entry sub and offset the drill string above the top entry sub;

inserting a wireline tool suspended from a wireline through the aligned entry port into the drill string below the entry sub;

positioning the deflection knuckles to align the drill string above and below the entry sub and offset the entry port; and operating the tool in the drill string below the entry sub with the wireline through the entry port.

47. The method of claim 46 wherein positioning the deflection knuckles to align the top entry sub comprises vertically restraining the drill string at the rotary table and lowering the top drive.

48. The method of claim 46 wherein positioning the deflection knuckles to offset the entry port comprises raising the top drive to tension the top entry sub in the drill string.

49. The method of claim 46 wherein operation of the tool in the drill string occurs while offsetting the entry port.

50. The method of claim 46 wherein operation of the tool in the drill string occurs while aligning the entry port.

51. The method of claim 46 further comprising applying torque via the rotary table to the drill string with the tool therein.

52. The method of claim 46 further comprising reciprocating the drill string with the tool therein via the top drive.

53. The method of claim 46 further comprising aligning the entry port for removal of the tool subsequent to the operation of the tool in the drill string.

54. The method of claim 46 further comprising providing a hardened wear sleeve in the top entry sub to inhibit erosion by the wireline.

55. The method of claim 46 further comprising aligning the entry port during deployment or retraction of the wireline through the entry sub to inhibit wireline erosion.

56. The method of claim 55 further comprising stopping deployment or retraction of the wireline through the entry sub when the entry port is offset to inhibit wireline erosion.

* * * * *